United States Patent [19]

Kingsley

[11] 4,088,403

[45] May 9, 1978

[54] REPLENISHABLE PHOTOSENSITIVE SYSTEM

[75] Inventor: William Kingsley, Rochester, N.Y.

[73] Assignee: Xerox Corporation, Stamford, Conn.

[21] Appl. No.: 718,289

[22] Filed: Aug. 27, 1976

[51] Int. Cl.[2] ..... G03G 15/00

[52] U.S. Cl. ..... 355/16; 355/3 BE; 355/77; 355/132

[58] Field of Search ..... 355/16, 3 BE, 3 R, 77, 355/132

[56] References Cited

U.S. PATENT DOCUMENTS

| | | | |
|---|---|---|---|
| 3,170,651 | 2/1965 | Galke et al. | 242/181 |
| 3,480,361 | 11/1969 | Doi et al. | 355/16 |
| 3,588,242 | 6/1971 | Berlier et al. | 355/16 |
| 3,829,208 | 8/1974 | Van Meijel et al. | 355/16 X |

OTHER PUBLICATIONS

"Xerographic Drum", R. A. Berlier et al., *IBM Tech. Bull.* vol. 15, No. 4, Sep. 1972, p. 1261.

*Primary Examiner*—Richard L. Moses
*Attorney, Agent, or Firm*—J. J. Ralabate; C. A. Green; H. Fleischer

[57] ABSTRACT

A reproducing machine in which successive photosensitive members are advanced from storage to the operative location therein. Each photosensitive member is used in the reproducing machine a predetermined interval and then automatically removed therefrom with the next successive photosensitive member being advanced thereto.

11 Claims, 6 Drawing Figures

REPLENISHABLE PHOTOSENSITIVE SYSTEM

BACKGROUND OF THE INVENTION

This invention relates generally to a reproducing machine, and more particularly concerns a system for advancing successive photosensitive members to an operative location in the reproducing machine after a predetermined interval of usage.

In a typical reproducing machine, as exemplified by an electrostatographic printing machine, a latent image is recorded on an insulating medium and developed with charged particles. A sheet of support material is positioned closely adjacent to the latent image and arranged to have the particles transferred thereto, in image configuration. After the particles are transferred to the sheet of support material, they are permanently affixed thereto forming a copy of the original document. Electrophotographic printing and electrographic printing are different versions of electrostatographic printing. In the process of electrophotographic printing, photoconductive insulating medium is sensitized and irradiated with a light image of an original document. The light image dissipates the charge on the photoconductive insulating medium in accordance with the intensity thereof. This records an electrostatic latent image on the photoconductive insulating medium corresponding to the original document being reproduced. Electrographic printing differs from electrophotographic printing in that an insulating medium is employed to form, without the aid of electromagnetic radiation, an electrostatic latent image for producing a viewable record.

In electrophotographic printing, the photoconductive insulating member is continually re-used. Generally, the photoconductive insulating medium is constructed from a photoconductive drum which continually recirculates. After an interval of usage, the photoconductive surface fatigues and does not recover satisfactorily. At this time, the drum must be replaced. Typically, a drum might be usable for thousands of copies. However, inevitably, the drum must be replaced. Recently, the photoconductive insulating medium has been made in the form of an endless web or belt. The belt configuration has numerous design advantages such as being incrementally advanceable so that successive new portions thereof may be periodically moved to an operative position. However, the typical belt or drum configuration is extremely difficult to replace. Moreover, the belt or drum frequently has used toner particles clinging thereto which increase the difficulty in handling during the removal thereof from the printing machine.

Some of these difficulties have been overcome by the prior art. For example, U.S. Pat. No. 3,619,050 issued to Swanke discloses an automatic endless photoconductive belt replacement system. This system uses a tow bar arrangement that engages slots in the leading and trailing edges of the replacement photoconductive belt. The tow bar grips the leading edge of the photoconductor at a replacement station and unwinds the photoconductor. It carries the photoconductor around a conveyor mechanism. Thereafter, it engages the trailing edge of the photoconductor. The photoconductor is then tensioned about the conveyor so as to secure it on a supporting mechanism. U.S. Pat. No. 3,877,806 issued to Schrempp et al. describes an apparatus for continually replacing increments of a photoconductive belt with fresh segments from a cartridge thereof. However, none of the prior art appear to teach the automatic replacement of successive photoconductive belts after a predetermined interval of usage. Moreover, there does not appear to be any teaching of a storage mechanism for housing a plurality of photoconductive members, each of which may be automatically advanced to the operative position in the electrophotographic printing machine.

Accordingly, it is a primary object of the present invention to improve reproducing machines by having a plurality of photoconductive members stored therein and advanced successively therefrom to the operative position after a predetermined interval of usage.

SUMMARY OF THE INVENTION

Briefly stated, and in accordance with the present invention, there is provided a reproducing machine having at least one photoconductive member in an operative location therein.

Pursuant to the features of the present invention, there is provided means for storing a plurality of photoconductive members. Means remove the photoconductive member from the operative location after a predetermined interval of usage, and advance the next successive photoconductive member from the storing means to the operative location.

BRIEF DESCRIPTION OF THE DRAWINGS

Other objects and advantages of the present invention will become apparent upon reading the following detailed description and upon reference to the drawings, in which.

Figure 1:
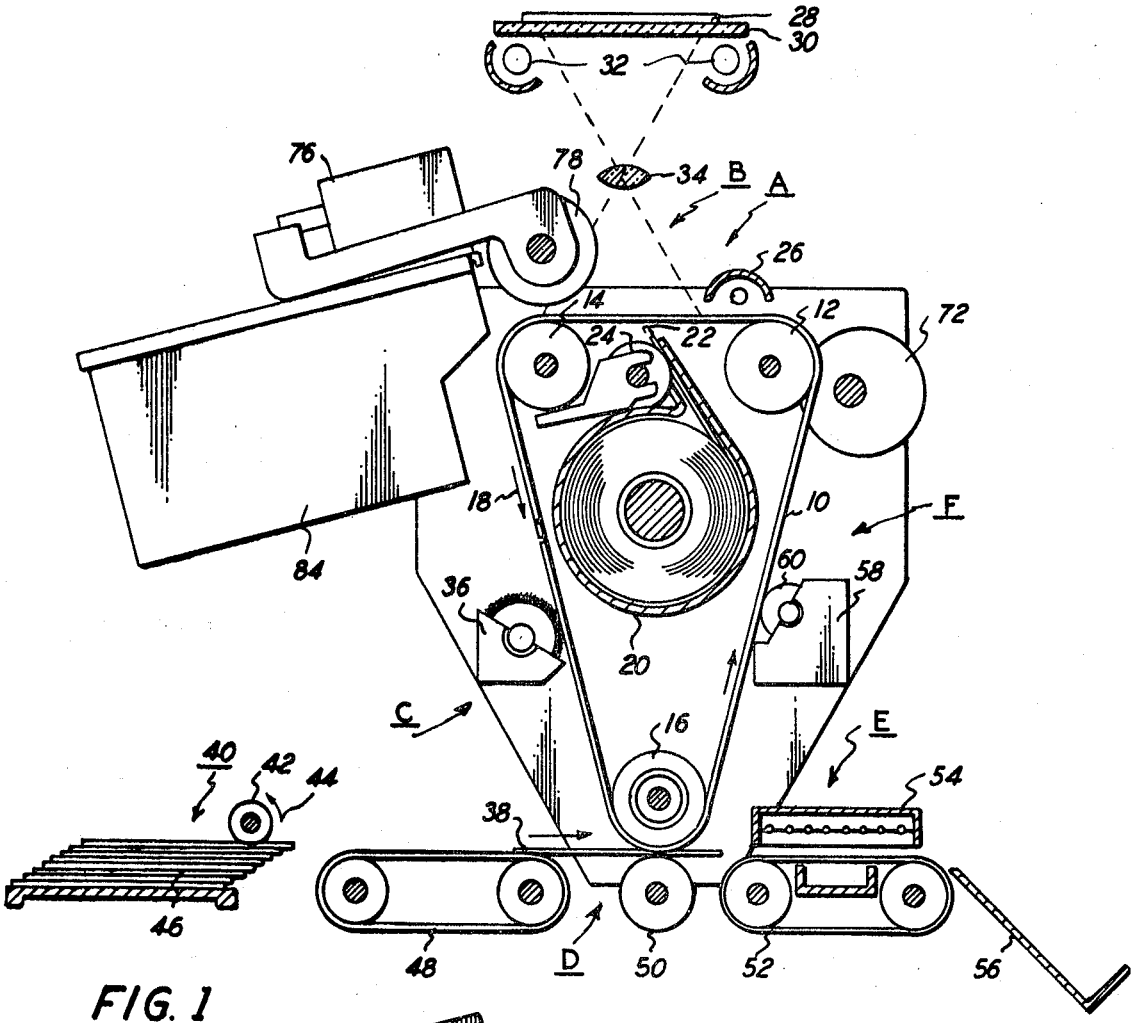
FIG. 1 depicts schematically, in elevation, an electrophotographic printing machine incorporating the features of the present invention therein.
Figure 3:
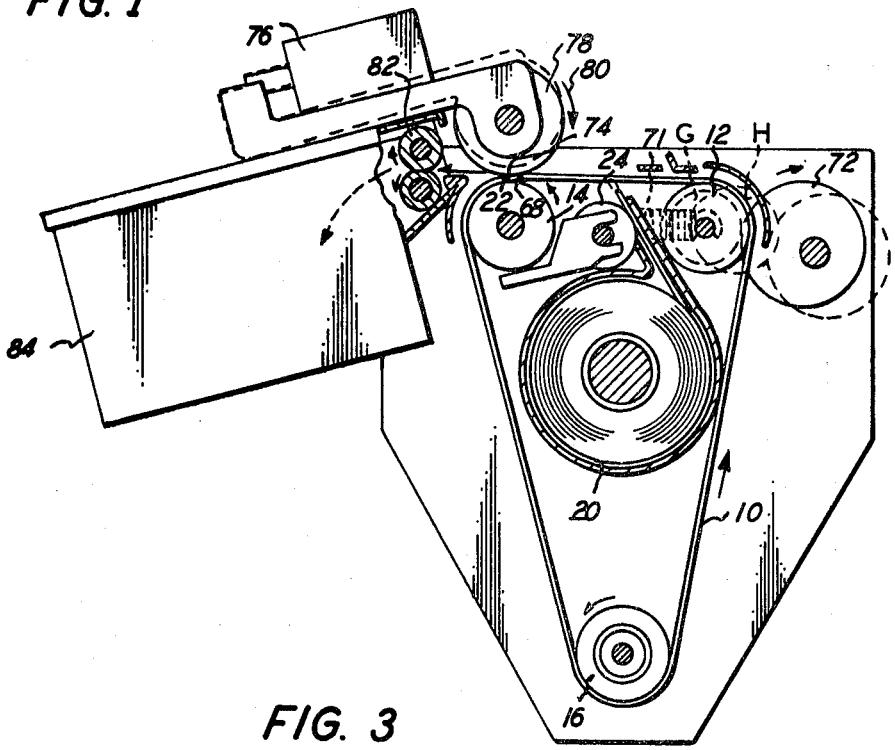

FIG. *2a* illustrates schematically, in elevation, the advancement of an unused photoconductive member from a storage spool;

FIG. *2b* shows the FIG. *2a* photoconductive member being advanced about an endless path in the operative location of the FIG. 1 printing machine;

FIG. *2c* depicts the FIG. *2a* photoconductive member entrained about the endless path;

FIG. *2d* illustrates coupling of the leading and trailing marginal edge portions of the FIG. *2a* photoconductive member to one another; and FIG. 3 shows the removal of the photoconductive member from the endless path of the FIG. 1 printing machine after a predetermined interval of usage.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine incorporating the features of the present invention therein, reference is had to FIG. 1 which depicts schematically the various components thereafter. Hereinafter, like reference numerals will be employed throughout to designate identical elements. Although the replenishing system described herein for photoconductive belts is particularly well adapted for use in the electrophotographic printing machine depicted in FIG. 1, it should become evident from the following discussion that it is equally well suited for application in a wide variety of reproducing machines and is not necessarily limited to the particular embodiment shown herein.

Inasmuch as the art of electrophotographic printing is well known, the various processing stations for producing a copy of an original document will be represented in FIG. 1 schematically. Each station will be described briefly hereinafter.

Referring now to FIG. 1, the electrophotographic printing machine employs a flexible photoconductive belt 10 entrained about a plurality of opposed spaced rollers 12, 14 and 16. By way of example, roller 14 is connected to a drive motor so as to advance photoconductive belt 10 from spool 20 housing a supply of belts 10 therein. The leading and trailing edges of each photoconductive belt are folded back over the belt body defining a U-shaped portion 22. After a predetermined interval of usage, drive roller 24 advances the next successive photoconductive belt from spool 20 with the prior photoconductive belt being removed therefrom. In this way, successive photoconductive belts are replaced or entrained about an endless path in the operative location of the printing machine, i.e., about rollers 12, 14 and 16. By way of example, photoconductive belt 10 may be made from a selenium alloy, or any other suitable photoconductive material. The detailed structural arrangement for advancing successive photoconductive belts from spool 20 and removing the used photoconductive belt from rollers 12, 14 and 16, will be described hereinafter in greater detail with reference to FIGS. 2 and 3. Continuing now with a description of the various processing stations disposed about belt 10, initially a portion of photoconductive belt 10 passes through charging station A.

At charging station A, a corona generating device, indicated generally by the reference numeral 26, charges a portion of photoconductive belt 10 to a relatively high substantially uniform potential. A suitable corona generating device is described in U.S. Pat. No. 2,836,725 issued to Vyverberg in 1958.

The charged portion of photoconductive belt 10 is advanced next to exposure station B. At exposure station B, original document 28, disposed upon transparent platen 30, is illuminated by lamps 32. The light rays reflected from original document 28 are transmitted through lens 34 onto the charged portion of photoconductive belt 10. In this manner, photoconductive belt 10 is irradiated selectively to dissipate the charge thereon and record an electrostatic latent image corresponding to the informational areas contained within original document 28.

Next, the electrostatic latent image recorded on photoconductive member 10 is advanced to development station C. At development station C, a magnetic brush developer unit, indicated generally by the reference numeral 36, deposits toner particles on the electrostatic latent image recorded on photoconductive member 10. Generally, a magnetic brush development system comprises a developer mix of carrier granules and toner particles being continually brought through a directional flux field forming a brush thereof. The brush of developer mix contacts the electrostatic latent image recorded on photoconductive member 10. The latent image attracts electrostatically the toner particles from the carrier granules to form a toner powder image on photoconductive member 10.

With continued reference to FIG. 1, a sheet of support material 28 is advanced by sheet feeding apparatus 40 to transfer station D. Sheet feeding apparatus 40 includes a feed roll 42 contacting the uppermost surface of the stack of sheets of support material 38. Feed roll 42 rotates in the direction of arrow 44 to advance the uppermost sheet from stack 46. Registration rolls (not shown) align and forward the advancing sheet of support material 38 onto conveyor 48. Conveyor 48 moves the sheet of support material into the nip between transfer roll 50 and roller 16.

At transfer station D, transfer roll 50 is electrically biased to a suitable potential and magnitude to attract electrostatically the toner particles from photoconductive member 10 to the sheet support material 38 interposed therebetween. After transferring the toner powder image to the sheet of support material 38, endless belt conveyor 52 advances sheet 38 to fixing station E.

Fixing station E includes fuser assembly, indicated generally by the reference numeral 54. Fuser assembly 54 heats the transferred powder image to permanently affix the toner particles to the sheet of support material. Thereafter, the sheet of support material is advanced by endless belt 52 to catch tray 56 for subsequent removal from the printing machine by the operator.

Frequently, residual toner particles remain adhering to photoconductive member 10 after the transfer of the toner powder image to the sheet of support material. These residual toner particles are removed from photoconductive member 10 at cleaning station F. Cleaning station F includes a cleaning mechanism, generally designated by the reference numeral 58, having a corona generating device (not shown) and a brush 60 contacting photoconductive member 10. Initially, the toner particles are brought under the influence of the corona generating device to neutralize the electrostatic charge remaining on photoconductive member 10 and that of the residual toner particles. Thereafter, the neutralized toner particles are removed from photoconductive member 10 by the rotatably mounted fibrous brush 16 in contact therewith. After cleaning, a discharge lamp floods photoconductive member 10 to return it to the initial charge level prior to the recharging thereof at station A for the next successive imaging cycle.

It is believed that the foregoing description is sufficient for purposes of the present application to illustrate the general operation of an electrophotographic printing machine employing the features of the present invention therein.

Figure 2A:
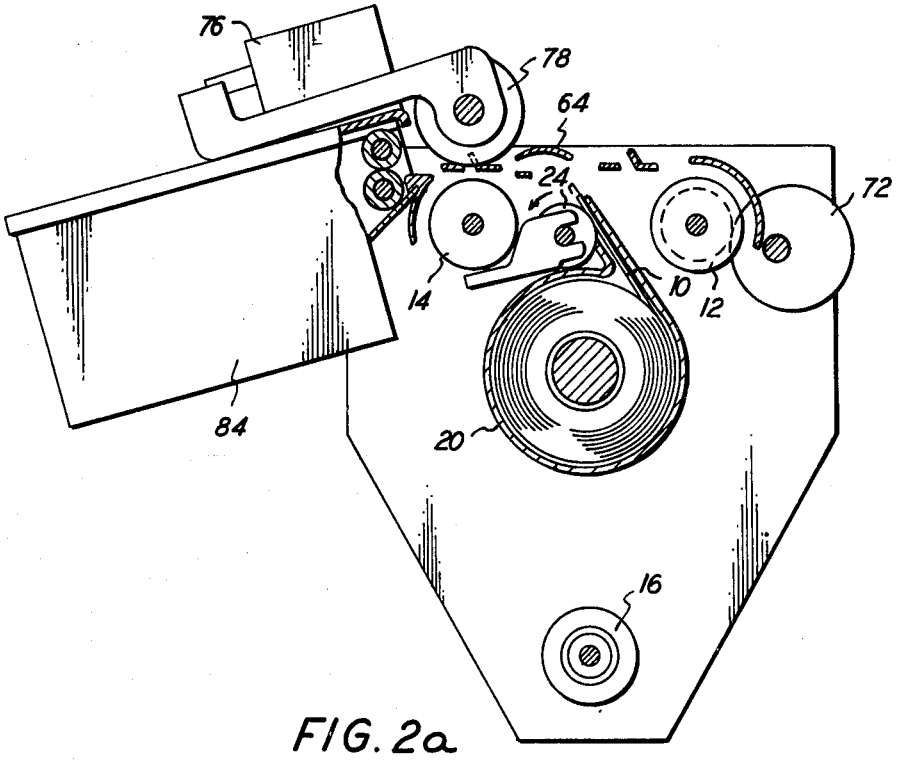

Referring now to the specific subject matter of the present invention, FIG. 2*a* depicts the start of advancement of photoconductive belt 10 from a storing means or spool 20 into the operative location, i.e., an endless path entrained about rollers 12, 14 and 16. Initially, after the prior photoconductive belt has been removed from rollers 12, 14 and 16, the next successive photoconductive belt 10 is advanced from spool 20. As shown in FIG. 2*a*, drive roller 24 is actuated to advance photoconductive belt 10 in the direction of arrow 62 so as to engage deflector 64.

Figure 2B:
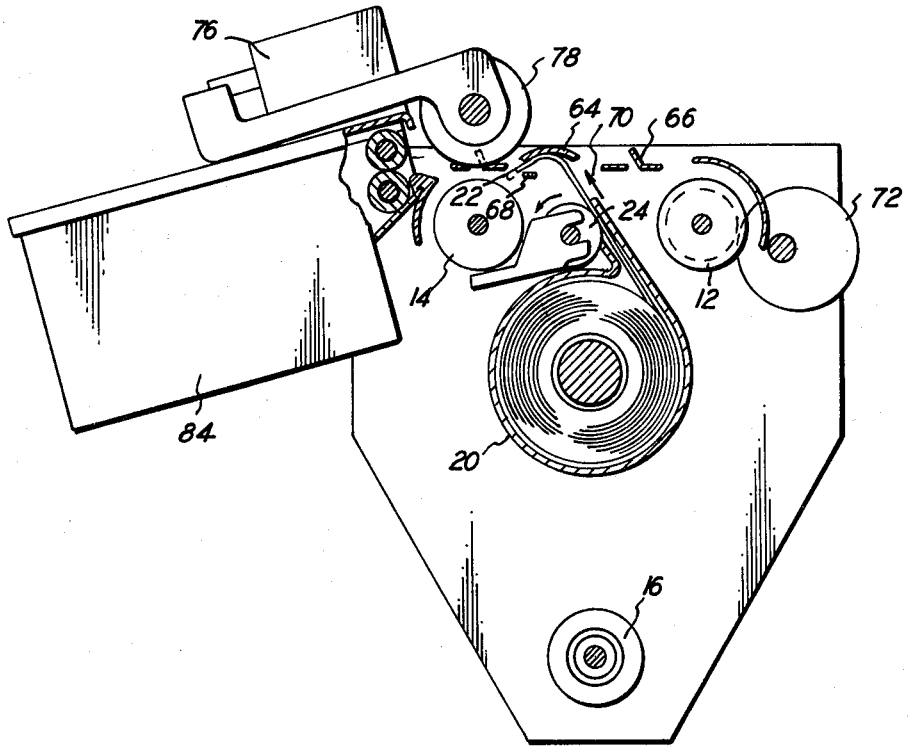

Turning now to FIG. 2*b*, switch 66 determines the location of tow bar 68 and actuates drive roller 24 to advance photoconductive belt 10 to a predetermined location. At this predetermined position, tow bar 68 automatically engages the leading U-shaped portion 22 of belt 10. Tow bar 68 unwinds photoconductive belt 10 from spool 20 to advance it in the direction of arrow 70.

In this manner, belt 10 is entrained about rollers 12, 14 and 16.

Figure 2C:
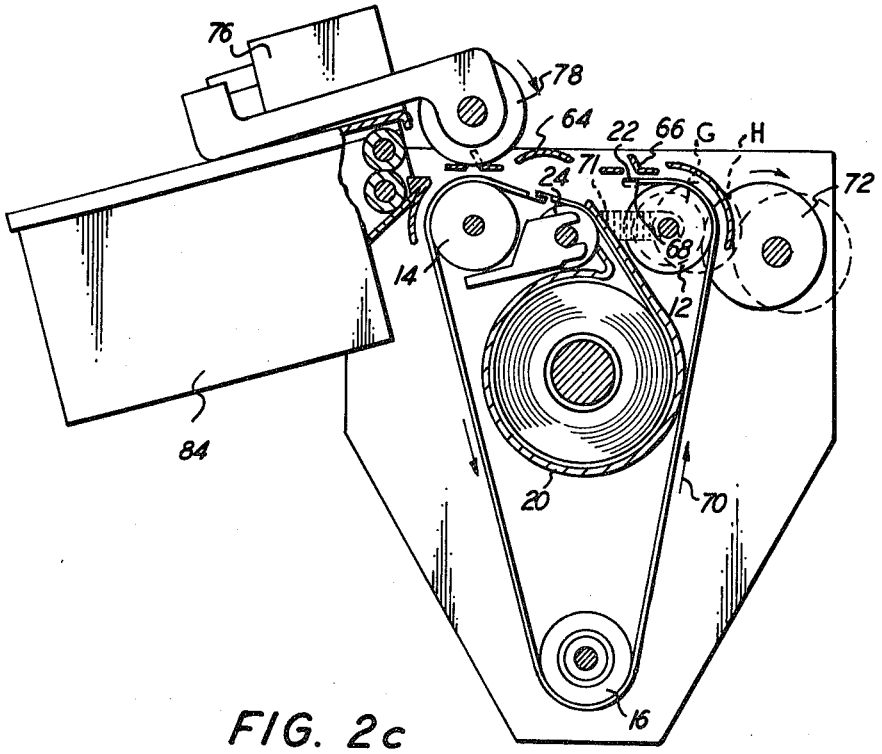

Turning now to FIG. 2*c*, after tow bar 68 advances about rollers 14, 16 and 12, it once again engages switch 66. Actuation of switch 66 by tow bar 68 energizes eccentric 72 which overcomes the force of spring 71 to urge roller 12 from position H to position G. At this time, drive roller 24 advances photoconductive belt 10 one pulse so that tow bar 68 uncouples the trailing portion 22 of photoconductive belt 10 from the leading portion of the next successive photoconductive belt.

Figure 2D:
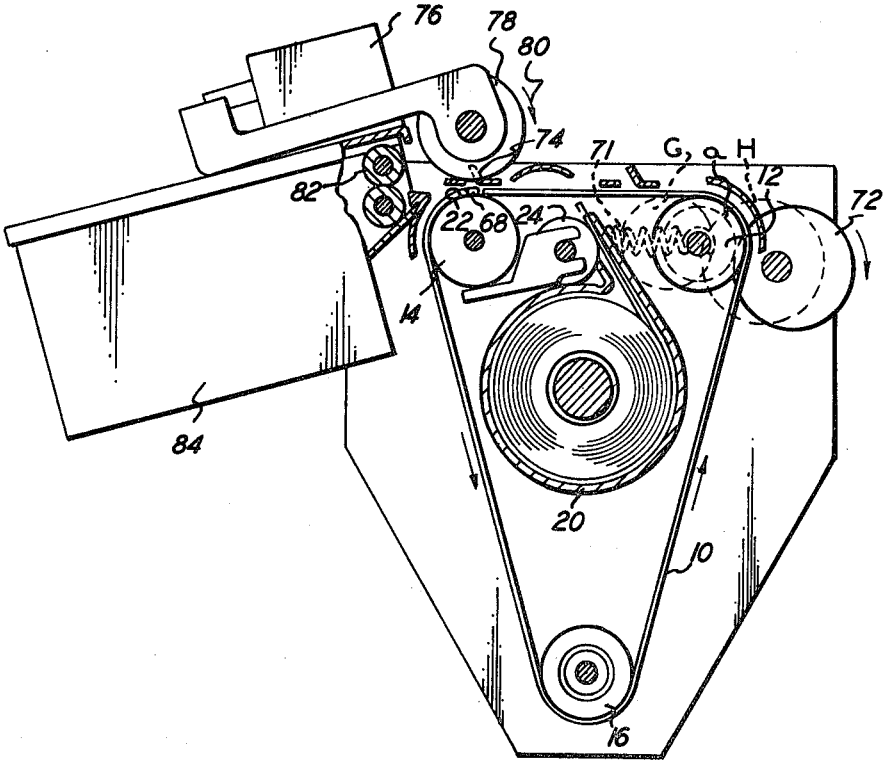

Referring now to FIG. 2*d*, as tow bar 68 continues to advance in the direction of arrow 70, it engages switch 74. Switch 79 causes eccentric 72 to move away from roller 12. This enables spring 71 to move roller 12 from position G to position H coupling the trailing U-shaped portion of belt 10 to tow bar 68. This attaches the leading and trailing portions of belt 10 to one another and places belt 10 under the requisite tension. Belt 10 then reverses its direction of movement and is ready for the copy mode of operation.

After a predetermined interval of usage, photoconductive belt 10 is removed from the operative location entrained about rollers 12, 14 and 16. By way of example, this may be about 40,000 copies. However, it may be any number of copies depending upon the characteristics of the photoconductive material being employed.

Turning now to FIG. 3, the system for removing photoconductive belt 10 from the operative location will now be described in detail. As shown therein, after a predetermined interval of usage, photoconductive belt 10 is removed from the operative location. This is achieved by tow bar 68 actuating switch 74. It should be noted that photoconductive belt 10 rotates about an endless path for successive copies and the number of times that switch 74 is actuated may be counted by suitable logic circuitry so as to initiate the removal of belt 10 from the operative location after a predetermined interval, i.e., corresponding to the number of copies made. Actuation of switch 74 energizes eccentric 72 moving roller 12 from position H to position G. In addition, solenoid 76 is actuated driving roller 78 in a downwardly direction to pinch U-shaped portions 22 between rollers 14 and 78. This pinching action and the rotation of roller 78 in the direction of arrow 80 drives the leading marginal U-shaped portion 22 offf tow bar 68 and into the nip between pinch rollers 82. Pinch rollers 82 advance photoconductive belt 10 into the chamber of housing 84. Thereafter, the next successive photoconductive belt 10 is advanced from spool 20 as hereinbefore described with reference to FIG. 2.

In recapitulation, it is evident that the system heretofore described removes successive photoconductive belts from the operative location after a predetermined interval of usage. Moreover, this system advances new, unused photoconductive belts into the operative location as the old, used photoconductive belt is removed therefrom. The foregoing is achieved automatically and permits a plurality of photoconductive belts to be stored within the electrophotographic printing machine so as to be advanced from the storage housing therefrom sequentially into the operative location at predetermined intervals.

It is, therefore, evident that there has been provided, in accordance with the present invention, an apparatus for storing and replenishing successive photosensitive belts in a reproducing machine after each belt has undergone a predetermined period of usage. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A reproducing machine of the type having at least one photoconductive member in a prescribed location, including:

means for storing a plurality of photoconductive members;

means, defining an endless path in the prescribed location for entraining the photoconductive member thereabout;

a rotating drive roller engaging the photoconductive member and advancing at least a portion of the photoconductive member from said storing means to a predetermined position; and a tow bar positioned to receive the leading edge of the portion of the photoconductive member advanced to the predetermined position by said drive roller, said tow bar moving about the endless path defined by said entraining means to dispose the photoconductive member thereat.

2. A reproducing machine of the type having at least one photoconductive member in a prescribed location therein, including:

a spool having a plurality of photoconductive members wound thereabout;

a plurality of spaced rollers, defining an endless path in the prescribed location, arranged to have the photoconductive member entrained thereabout;

a rotating drive roller engaging the photoconductive member;

a tow bar positioned to receive the leading edge of the photoconductive member advanced thereto by said drive roller, said tow bar moving about the endless path defined by said plurality of spaced rollers to entrain the photoconductive member thereabout; and means for receiving the photoconductive member removed from the endless path defined by said plurality of spaced rollers.

3. A reproducing machine as recited in claim 2, further including means for sensing the location of said tow bar and actuating said drive roller in response to said tow bar being at a predetermined position.

4. A reproducing machine as recited in claim 3, wherein the photoconductive member includes a flexible belt having the leading marginal edge portion thereof folded back over the flexible belt defining a first U-shaped portion and the trailing marginal edge portion thereof being folded back over the flexible belt defining a second U-shaped portion, said tow bar being arranged to couple said first U-shaped portion with said second U-shaped portion after entraining the flexible belt about the endless path defined by said plurality of spaced rollers.

5. A reproducing machine as recited in claim 4, further including means for resiliently urging one of said plurality of spaced rollers into engagement with the flexible belt after the first and second U-shaped portions thereof have been coupled to one another maintaining a pre-selected tension in the flexible belt.

6. A reproducing machine as recited in claim 5, further including means for disengaging the first U-shaped portion from said tow bar and moving the flexible belt to said receiving means enabling the next successive flexible belt to be entrained about the endless path defined by said plurality of spaced rollers.

7. A method of replacing successive photoconductive belts about a prescribed path in an electrophotographic printing machine, including the steps of:

storing a plurality of photoconductive belts in a supply station;

removing the photoconductive belt from the prescribed path after a predetermined interval of usage;

rotating a drive roller engaging the next successive photoconductive belt to advance at least a portion thereof from the supply station so that the leading marginal edge portion of the next successive photoconductive belt engages a tow bar; and moving the tow bar about the prescribed path so as to position the next successive photoconductive belt in the prescribed path.

8. A method of replacing successive photoconductive belts about a prescribed path in an electrophotographic printing machine, including the steps of:

storing a plurality of unused photoconductive belts about a spool;

removing the photoconductive belt from the prescribed path after a predetermined interval of usage;

receiving the used photoconductive belt removed from the prescribed path in a storage housing;

rotating a drive roller engaging an unused photoconductive belt to advance the leading marginal edge portion thereof into engagement with a tow bar;

moving the tow bar about the prescribed path so as to entrain the unused photoconductive belt about a plurality of spaced roller; and coupling the leading marginal edge portion with the trailing marginal edge portion of the unused photoconductive belt.

9. A method as recited in claim 8, further including the step of sensing the location of the tow bar and actuating the drive roller in response to the tow bar being at a predetermined position.

10. A method as recited in claim 8, further including the step of urging resiliently one of the plurality of spaced rollers into engagement with the photoconductive belt to obtain a preselected tension therein.

11. A method as recited in claim 10, wherein said step of removing includes the steps of:

disengaging the leading marginal edge portion from the trailing marginal edge portion of the photoconductive belt; and moving the photoconductive belt away from the prescribed path.

* * * * *